United States Patent [19]

Tolliver

[11] 4,358,078

[45] Nov. 9, 1982

[54] PIPE REINFORCING FABRIC

[76] Inventor: Wilbur E. Tolliver, 364 Hamilton Dr., Holland, Mich. 49423

[21] Appl. No.: 234,022

[22] Filed: Feb. 12, 1981

Related U.S. Application Data

[63] Continuation of Ser. No. 49,096, Jun. 18, 1979, abandoned.

[51] Int. Cl.[3] ..... E04C 5/02

[52] U.S. Cl. ..... 245/2

[58] Field of Search ..... 245/1, 2, 8; 139/425 R, 139/425 A; 138/174, 175, 176

[56] References Cited

U.S. PATENT DOCUMENTS

| | | | |
|---|---|---|---|
| 3,425,900 | 2/1969 | Purdy | 139/425 A |
| 3,840,054 | 10/1974 | Tolliver | 245/2 |
| 3,990,480 | 11/1976 | Borodin et al. | 138/175 |
| 4,079,500 | 3/1978 | Tolliver | 245/8 |

FOREIGN PATENT DOCUMENTS

| | | | |
|---|---|---|---|
| 2009357 | 6/1979 | United Kingdom | 138/175 |

*Primary Examiner*—John McQuade

*Attorney, Agent, or Firm*—Price, Heneveld, Huizenga & Cooper

[57] ABSTRACT

The specification discloses fabric for use in reinforcing concrete pipe. The fabric includes a plurality of circumferential defining line strands and a plurality of transverse strands positioned in spaced, parallel relationship to each other and extending generally perpendicular to the circumferential defining line strands. The transverse strands are divided into a plurality of sets having lengths equal to the predetermined reinforcement cage circumference. The circumferential defining line strands are divided along their lengths into quadrant defining portions. Additional reinforcement is provided at the quadrants wherein the areas of maximum stress will occur in the concrete pipe. The reinforcement may take the form of additional circumferential strands secured to the circumferential or transverse defining strands, a separate quadrant mat or fabric segment secured to the fabric, or the circumferential defining line strands may have an increased diameter at the desired quadrants in order to increase the steel area of the cage in the area of maximum stress that occur in the concrete pipe.

2 Claims, 11 Drawing Figures

PIPE REINFORCING FABRIC

This is a continuation of application Ser. No. 49,096, filed June 18, 1979, now abandoned.

BACKGROUND OF THE INVENTION

This invention relates to a wire fabric used in the reinforcement of concrete pipes.

Various forms of wire fabric have been proposed which upon fabrication into a cylindrical cage or elliptical cage shape are employed to reinforce concrete pipe. These fabrics generally include a plurality of transverse wire strands and a plurality of circumferential defining line strands. The fabric is typically provided to the pipe manufacturer by the fabric manufacturer in the form of a continuous roll or in sheets manufactured to size. The transverse strands have generally been spaced at 6, 8 or 12 inch intervals and when fabric is supplied in a continuous roll the pipe manufacturer has had to count the number of transverse wires to determine the correct length for a predetermined size of pipe. The fabric must then be cut, formed into a circular or elliptical cage and the ends of circumferential line strands of the fabric overlapped and secured together as by welding.

This procedure has resulted in a substantial amount of wasted fabric and increased fabrication time and cost due to the necessity of counting the transverse wires or spacings, required to yield a particular length of fabric for a predetermined cage for the pipe size. The spacing between the transverse wires or strands most generally yields a fabric length greater than the fabric length required for the circumference of the pipe reinforcing cage. Many of these problems have been alleviated by the wire fabric disclosed in U.S. Pat. No. 3,990,480, entitled METHOD AND FABRIC FOR MAKING REINFORCING CAGES, and filed on Jan. 20, 1975 by Wilbur E. Tolliver and Daniel J. Borodin. The disclosed fabric therein is divided into sets of transverse strands with each set separated by a space smaller than the spacing of transverse strands within each set. This results in a readily discernable severance or cut line for the shear operator and eliminates the necessity of counting transverse strands or spacing, to yield a length of fabric required for the predetermined pipe size. The fabric is made so that each set has a length corresponding to the circumference of the predetermined pipe size, for example. This fabric and method of making and using same substantially reduces the waste of the fabric from that heretofore experienced as well as increasing the efficiency of wire cage production.

Additional problems, however, are presented which are not solved by this fabric. For example, reinforcement requirements of certain classes of concrete pipe can best be furnished by including additional reinforcement or steel area at the quadrants of the cage wherein the maximum stresses in the concrete pipe occur. On the inside reinforcement cage the maximum stresses occur at the crown and the invert of the pipe and on the outside reinforcement cage at the spring lines of the pipe. Additional steel area is required in the quadrants which include the points of maximum stress. This additional reinforcement has generally been provided by cutting the predetermined fabric lengths, rolling or forming the fabric into a reinforcing cage, connecting the ends of the cut fabric and then tack welding properly dimensioned fabric mats or quadrant mats to the cage at the quadrants where additional steel reinforcement is required.

Also, it is sometimes advantageous or required to provide additional reinforcement in the form of stirrups at the point of maximum stress at the pipe crown and invert. The stirrups are projections, which when secured to the fabric in the areas of the maximum stress quadrants, extend radially outwardly from the cage. The stirrups have typically been attached to the fabricated pipe reinforcing cage resulting in the need for substantial more labor to complete the cage.

SUMMARY OF THE INVENTION

In accordance with the present invention, a unique wire fabric and method of using same is provided whereby a complete reinforcing cage including the required quadrant reinforcement at the areas of maximum stress may be formed in the field by the pipe manufacturer merely by cutting off lengths of a roll of the fabric or by using sheets of fabric, forming the cut fabric or fabric sheet into a cylindrical or elliptical cage and joining the ends of the fabric. In roll form, the wire fabric includes a plurality of circumferential defining line strands and a plurality of transverse strands positioned in spaced, parallel relationship to each other and extending generally perpendicular to the circumferential defining line strands. The transverse strands are divided into a plurality of sets with each set being spaced from an adjacent set along the circumferential defining line strands a distance less than the spacing of the transverse strands within each set to thereby define readily discernable cut lines. In either roll form or sheet form, provision is made for increasing the steel area in the direction of the circumferential defining line strands in predetermined areas which will subsequently become located within the pipe wall at the quadrants of maximum stress when the fabric is cut and formed into a reinforcing cage. The transverse strands may be spaced in the maximum stress quadrants a distance equal to that required for use of stirrup reinforcement or to a predetermined distance. In the remaining two quadrants, the spacing of the transverse strands may be increased to that required for supporting the circumferential defining line strands or to a predetermined distance equal to or greater than the spacing at point of maximum stress.

As a result, a fabric is provided which is readily cut into predetermined lengths or is manufactured as sheets, which includes all necessary reinforcement and which requires only that the ends of the cut fabric or fabric sheet be joined. The fabric permits pre-attachment of stirrups during fabric manufacture to transverse strands which are already laid to mark the spacing required for the stirrups. The fabric and method for making and using same therefore reduces the reinforcing cage fabrication time, cost and difficulty; eliminates wasteful use of fabric; and results in substantial savings in steel material.

DETAILED DESCRIPTION OF THE PREFERRED EMBODIMENT

Figure 1:
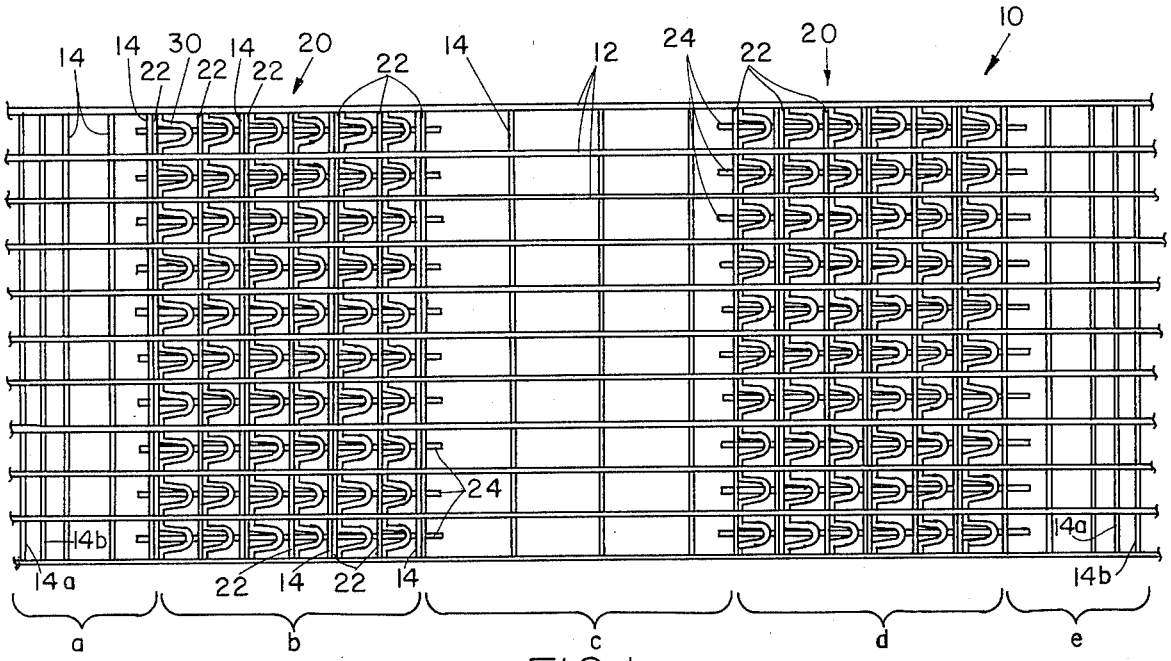
FIG. 1 is a fragmentary, plan view of the unique fabric in accordance with the present invention.

In the embodiment illustrated in FIG. 1, the fabric 10 includes a plurality of longitudinal or circumferential defining line strands 12 and a plurality of transverse strands 14. These strands are interconnected such as by conventional welding operations and further are oriented at right angles to one another. The circumferential defining line strands 12 are spaced from each other at substantially equal intervals and extend parallel to each other. The transverse strands 14, however, are arranged in sets with some visible designation between sets to tell an operator or an automatic machine where the fabric should be cut. Preferably, the last strand **14*b* of each set is spaced from the first strand 14*a* of the next adjacent set by a distance which is just sufficiently great to allow the fabric to be cut between the sets. Typically, the spacing between the last strand of one set and the first strand of the next adjacent set would be approximately two to three inches. This spacing is less than the spacing between the transverse strands 14** within a particular set so as to define readily discernable cut or severance lines. Further, the distance along the circumferential defining line strands between the first and last strands of each transverse set corresponds to a reinforcing cage circumference for a predetermined class and size of concrete pipe. During the manufacture of the fabric, the line strands are divided longitudinally into preselected portions a, b, c, d, and e. Portion a has a length corresponding to one-eighth of the total length of the transverse set. Portions b, c, and d have lengths corresponding to one-fourth the length of the transverse set and portion e has a length corresponding to one-eighth of the length of the transverse set. As will be more fully described below, portions b and d correspond to the areas of maximum stress in the concrete pipe for which the subsequently formed reinforcing cage will be employed.

In the alternative, the fabric can be shipped in sheets made to appropriate length. This eliminates yet another step for the pipe producer.

Figure 2:
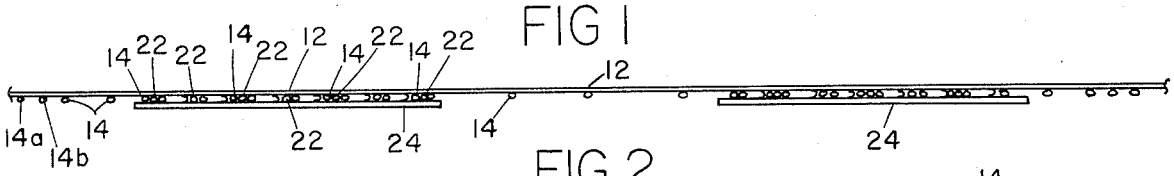
FIG. 2 is a fragmentary, enlarged, side elevational view of a portion of the fabric of FIG. 1.

In the manufacture of certain sizes and classes of reinforced concrete pipe, it is desirable that these areas of maximum stress be provided with additional reinforcement when compared to the areas of minimum stress. Applicable concrete pipe standards require that the steel area in these areas be increased. The steel area is defined as the sum of the cross-sectional areas of the strands which are circumferential defining line strands. Heretofore, the increased steel area required in the areas of maximum stress has been obtained by forming the reinforcing cage from the fabric and then tacking to the preselected portions of the cage reinforcement mats or quadrant mats which have first been rolled into an arcuate configuration. In accordance with the present invention, these additional fabrication steps by the pipe manufacturer are eliminated. As best seen in FIGS. 1 and 2, quadrant reinforcing mats 20 including quadrant transverse strands 22 and quadrant line strands 24 are integrally secured to areas b and d of each transverse set during the fabric manufacturing process. As seen in FIG. 2, the transverse strands 22 of the quadrant mat are welded to the circumferential defining strands 12 of the fabric. In the alternative, the line strands 24 may be welded to the transverse strands 14 of the fabric, or both may be done.

Figure 3:
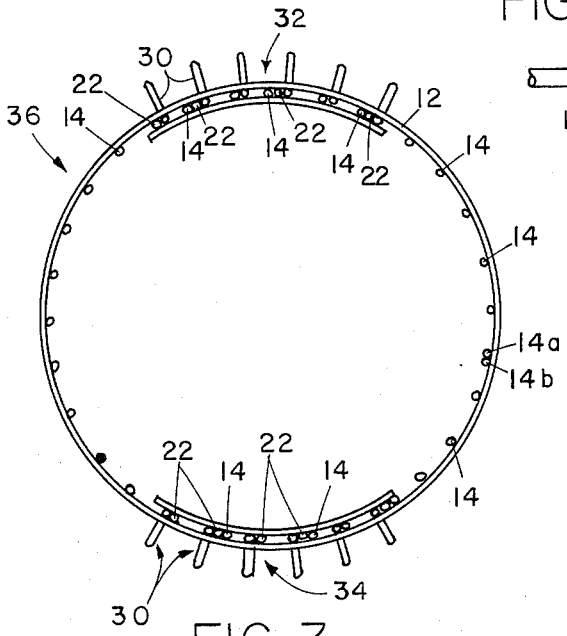
FIG. 3 is an end elevational view of a cage made from the fabric of FIG. 1.

The transverse strands 22 of the quadrant mat are spaced to accommodate reinforcing stirrups 30 schematically illustrated in FIG. 3. These reinforcing stirrups may be of the type disclosed in U.S. Pat. No. 3,840,054 entitled STIRRUP FABRIC PIPE REINFORCEMENT and issued on Oct. 8, 1974 to Wilbur E. Tolliver, the inventor of the present invention. The stirrups are employed to provide additional reinforcement at the areas of maximum stress with certain classes and sizes of concrete pipe. The stirrups may be hingedly secured to the transverse strands of the quadrant mats and placed in a foled position. With the fabric illustrated in FIG. 1, the spacing between the transverse strands 14 may be made uniform and set so as to merely support the circumferential defining line strands since the spacing between the transverse strands of the quadrant mats is made to accommodate the stirrup reinforcement.

When the resulting fabric is unrolled and the sets of transverse strands are cut into cage forming sections, they may be rolled into the cages and then the stirrups may be erected.

As best seen in FIG. 3, the pipe manufacturer will sever the fabric at the readily discernable cut lines and roll the fabric into an elliptical or circular cylindrical reinforcing cage. When a single elliptical reinforcement cage is employed, or in an inside cage of a two cage assembly, the maximum stress will occur at the crown 32 and at the invert 34 of the pipe and cage. The minimum stress will occur at the spring line 36 of the pipe and cage. The quadrant reinforcement including the reinforcing stirrups will extend through an arc of 60°–90°. This arc area of the cage therefore, includes the areas of maximum stress of the concrete pipe reinforced by the fabric. Once the fabric has been severed or cut into the required sets or sections, the pipe manufacturer need only roll it into the predetermined cage shape and weld or otherwise secure the ends of the fabric together at the spring lines or point of minimum stress of the cage with transverse strands **14*a* and 14*b* closely adjacent one another. Therefore, the fabric illustrated in FIGS. 1 and 2** substantially reduces the time consuming fabrication steps, results in a decrease in the amount of wasted fabric and the required quadrant reinforcement for particular size and class of pipe is provided without any additional steps by the pipe manufacturer.

Figure 4:
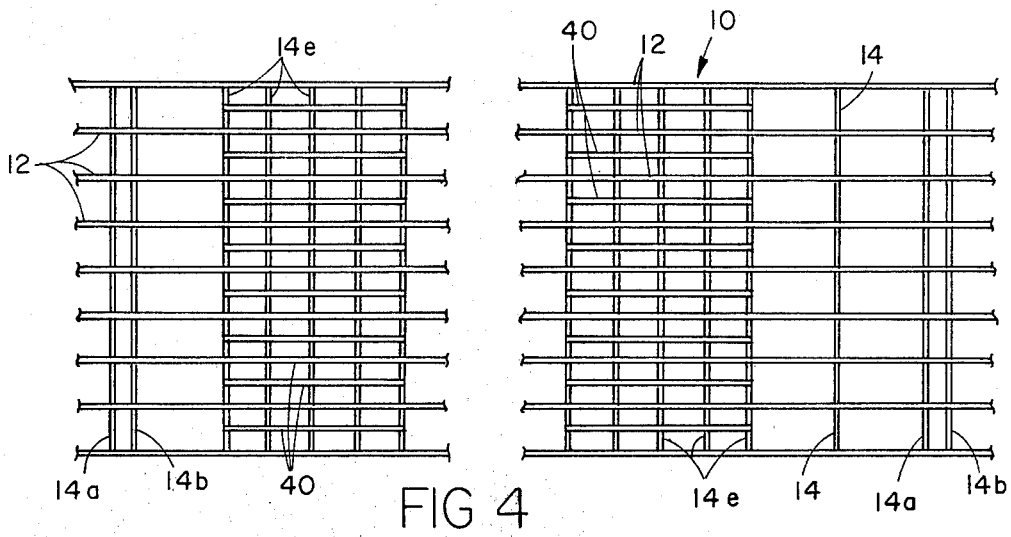
FIG. 4 is a plan view of an alternative embodiment of the fabric in accordance with the present invention.

In the alternative embodiment illustrated in FIG. 4, the quadrant reinforcement is provided by joining a plurality of reinforcing strands 40 to the fabric 10 at the preselected portions which correspond to the areas of maximum stress in the completed concrete pipe. The reinforcing strands 40 are positioned on the fabric and extend parallel to the circumferential defining line strands 12. In this embodiment, the reinforcing strands 40 are joined to the transverse strands 14 of the fabric, preferably on the same side as circumferential strands 12. This is a more preferable embodiment of the invention as compared to the FIGS. 1–3 embodiment in that this fabric would be easier to roll form than the FIGS. 1–3 embodiment with this embodiment fabric, the roll formers would never have to roll over more than two thicknesses of wire whereas in the FIGS. 1–3 embodiment, the formers have to roll over three thicknesses of wire at the quadrant areas. Further, with this embodiment the spacing between the transverse strands 14*e* which are positioned within the preselected portions of the set are spaced differently from the transverse strands 14 outside of the preselected portions (strands 14, 14*a*, 14*b* and 14*e* lying in a common plane). It is preferred that the transverse strands 14*e* within these portions be spaced closer together in order to accommodate the stirrup reinforcement or for better mechanical anchoring ability. Typically, this spacing will be at approximately 4 or 6 inch intervals. Outside of this reinforced area, the transverse strands 14 may be spaced a greater distance which is sufficient to support the circumferential defining line strands 12. This feature results in a substantial savings in material and the fabrication of a fabric designed to accommodate the stirrup reinforcement.

Figure 5:
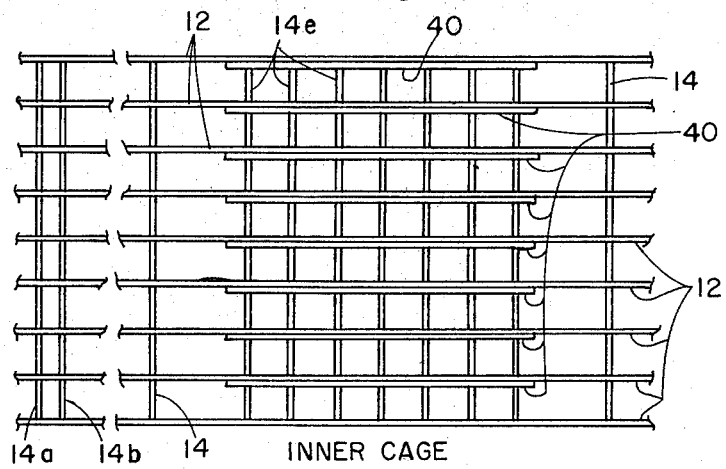
FIG. 5 is a plan view of another alternative embodiment of the fabric in accordance with the present invention.

The embodiment illustrated in FIG. 5 is similar to that shown in FIG. 4 except that the reinforcing strands 40 are joined to the fabric 10 by welding them to the circumferential defining line strands 12 of the fabric 10. The circumferential defining line strands 12 and the transverse strands 14 are arranged in the desired relationship and the reinforcing strands 40 are positioned in engagement with the strands 12. The strands are then joined together employing conventional welding techniques. As with the embodiment illustrated in FIG. 4, the transverse strands 14 within the preselected areas or portions are preferably spaced so as to accommodate the stirrup reinforcement.

Figure 6:
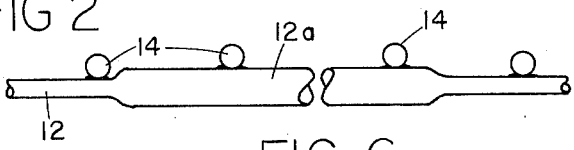
FIG. 6 is a fragmentary, side elevational view of a further alternative embodiment of the fabric in accordance with the present invention.

A further alternative embodiment for obtaining the required increase in steel area within the selected portions of the fabric is shown in FIG. 6. In this embodiment, the circumferential defining line strands 12 are formed with quadrant portions 12*a* having a diameter greater than the diameter of the strands 12 outside of the areas where additional quadrant reinforcement is required. The diameter of portions 12*a* is such that the steel area of the fabric at the quadrants of the subsequently formed cage will be that required for the particular class and size of concrete pipe to be manufactured. As with the embodiments illustrated in FIGS. 4 and 5, the spacing between the transverse strands 14 within the preselected quadrant portions of the fabric is made to accommodate the stirrup reinforcement. The circumferential defining line strands of the embodiment illustrated in FIG. 6 are formed with the portions of increased diameter employing conventional manufacturing processes. This embodiment substantially reduces the steps required in the fabrication of a fabric having integral quadrant reinforcement.

Figure 7:
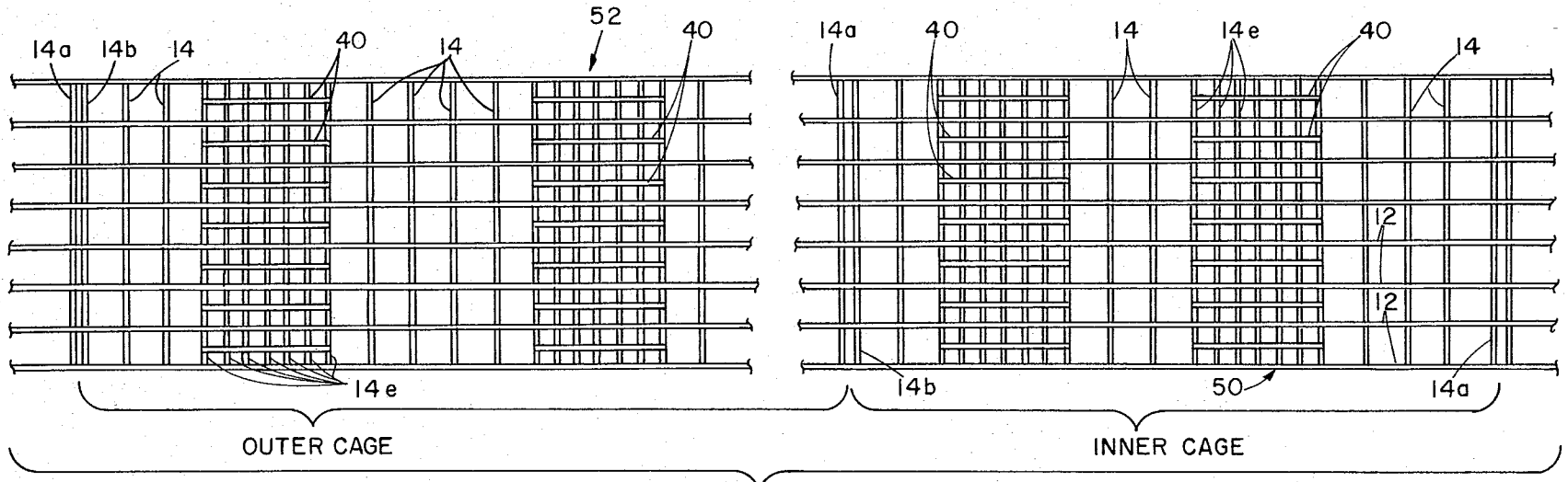
FIG. 7 is a plan view of a section of yet another alternative embodiment of the fabric in accordance with the present invention.

In the embodiment illustrated in FIG. 7, the sets of transverse strands separated by the readily discernable cut lines are dimensioned so that they may be severed into lengths for the ready manufacture of inner and outer reinforcing cages. With certain sizes and classes of concrete pipe, two cages are employed. The length of the transverse set generally designated 50 corresponds to the preselected inner cage. The set designated 52 corresponds to the predetermined outer cage. Each set, of course, includes the required integral quadrant reinforcement.

The FIG. 7 fabric is made along the lines of the most preferred FIG. 4 fabric in that the transverse strands 14*e* within the quadrant areas are spaced more closely together than the transverse strands 14 outside the quadrant area. Also, strands 40 and 12 lie in a common plane and strands 14*e* and 14 lie in a common place.

Figure 8:
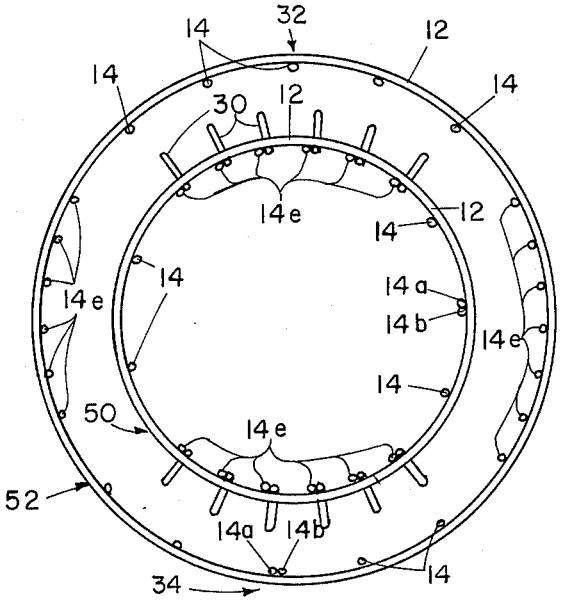
FIG. 8 is an end elevational view of an inside/outside cage arrangement made from the fabric illustrated in FIG. 7.

The inner and outer cage arrangement formed from the fabric illustrated in FIG. 7 is shown in FIG. 8. As shown therein, the inner cage is reinforced at the pipe crown and invert. This reinforcement includes the stirrups 30 and any one of the previously described embodiments for increasing the steel area along the circumferential defining line strands. With the outer cage, the areas of maximum stress occur at the spring lines while the areas of minimum stress occur around the crown and invert. Therefore, in manufacturing the reinforcing cage illustrated in FIG. 8, the pipe manufacturer will unroll the fabric, sever the fabric along the readily discernable cut lines, roll the set corresponding to the inner cage into the desired shape and weld the ends at the spring line of the inner cage. Next, the manufacturer will roll the set corresponding to the outer cage into the desired shape and join the ends of this at the crown or the invert. The inner cage is then positioned coaxially with the outer cage and the stirrups 30 are erected. With this embodiment as with the previous embodiments, the pipe manufacturer need only buy a single roll of fabric for manufacturing a complete run of pipe having the required reinforcement for the particular class and size. The manufacture of concrete pipe requiring the composite cage construction is made substantially more simple when the fabric illustrated in FIG. 7 is employed.

Figure 9:
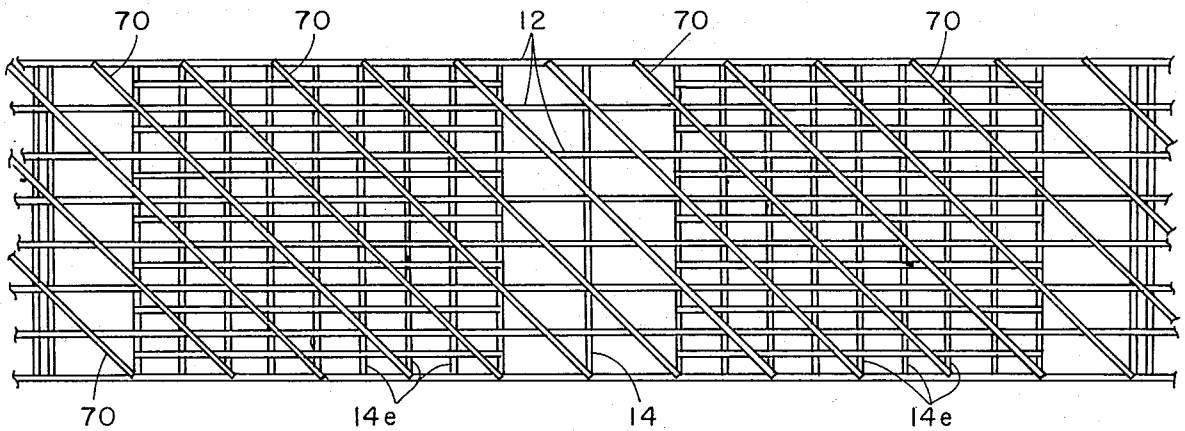
FIG. 9 is a plan view of a section of yet a further alternative embodiment of the fabric made in accordance with the present invention.

As a further alternative embodiment, the fabric may be provided with diagonal strands 70 as shown in FIG. 9. The diagonal strands 70 are positioned on the fabric during the fabric manufacture so as to extend at a predetermined angle across the fabric. The diagonal strands 70 are employed when the pipe is manufactured by a packer head machine. The diagonals resist torsional stresses induced in the fabric during operation of the packing device and therefore reduce the incidence of cage distortion during this type of pipe manufacturing process.

Figure 10:
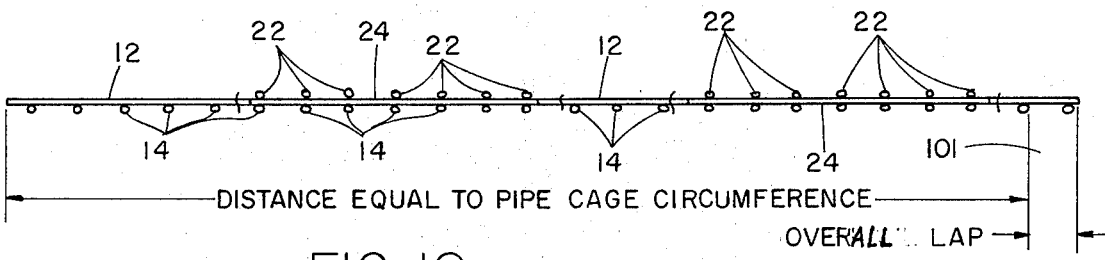
FIG. 10 is a side elevational view of a sheet of fabric made in accordance with the invention.

FIG. 10 shows a sheet of fabric 100 with a length appropriate for rolling a particular size reinforcing cage, including an overhang or lap portion 101. Each sheet 100 is much like a segment on a roll of fabric 10 as shown in FIGS. 1 and 2. However in this embodiment, the quadrant reinforcing transverse strands 22 lie on the opposite side of the fabric from transverse strands 14, rather than in the same plane therewith. The circumferential defining strands 12 lie in the same plane as the circumferential defining strands 24 of the quadrant reinforcement. This embodiment will also probably pass through roll formers more easily than the FIG. 1 embodiment, but probably not as easily as the FIGS. 4, 5 and 7 embodiments.

Figure 11:
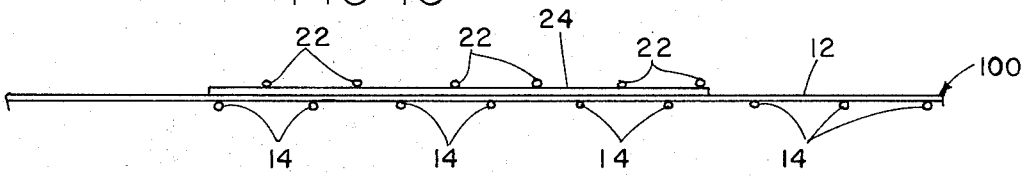
FIG. 11 is an enlarged view of a portion of the FIG. 10 fabric.

FIG. 11 is an enlarged view of a small portion of FIG. 10. It illustrates that the quad circumferential strand 24 can be of a larger diameter than the main circumferential 12. Thus, even though quad circumferential 24 contacts transverse strands 14 and is generally in the same plane as circumferential 12, it does project below the bottom of strands 12 because it is thicker.

It should be readily apparent that the unique fabric and the unique method of making and using same which forms the subject matter of the present invention substantially reduces the amount of wasted material inherent in the manufacture of steel reinforced concrete pipe than heretofore possible. Further, the fabric since it includes the integral quadrant reinforcement and is divided into sets having lengths equal to that required for the reinforcement of the predetermined class and size of pipe, substantially reduces the steps required by the pipe manufacturer in the fabrication of the cages. The pipe manufacturer need merely cut off the predetermined lengths of the roll of the fabric, form the cut fabric into a cylindrical or elliptical cage and join the ends of the fabric. Even the cutting can be eliminated when the fabric is shipped as a plurality of separate sheets. This fabric and method of making and using same therefore substantially decreases the time and costs attendant to the manufacture of steel reinforced concrete pipe.

Of course, it should be understood that the above is intended to be a description of the preferred embodiments only. The true spirit and scope of the present invention may be determined by reference to the appended claims.

The embodiments of the invention in which an exclusive property or privilege is claimed are defined as follows:

1. In a wire fabric, having a plurality of circumferential defining line strands extending the length of said fabric; each of said strands having at least a first circumferential cross sectional area throughout its length, being joined to a plurality of transverse strands, and adapted to be cut and formed into a plurality of reinforcing cages for use in reinforcing concrete pipe, the improvement comprising, in combination:

visible indicator means at spaced intervals, separating and facilitating cutting of said fabric into a plurality of sets of transverse strands, each set of transverse strands corresponding in length to the circumference plus desired overhang of a particular reinforcing cage to be formed;

reinforcing means as a part of said fabric; said reinforcing means being positioned only at spaced preselected portions of each said set of transverse strands, and terminating along the length of said fabric at each side of said preselected portions such that said reinforcing means are spaced from one another along the length of said fabric and increase the strength and concrete pipe reinforcing capability of the wire fabric by increasing the circumferential cross sectional area of said wire fabric only at said preselected portions; said preselected portions being located at the areas of maximum stress of the concrete pipe to be reinforced by said fabric;

said reinforcing means comprising said circumferential defining line strands having a greater diameter in said preselected portions of said fabric than in the remaining portions of said fabric.

2. The improved wire fabric as defined in claim 1 wherein said reinforcing means comprises:

quadrant reinforcing strands secured to said fabric and positioned generally parallel to said circumferential defining line strands along said preselected portions of said fabric whereby the fabric includes integral quadrant reinforcement.

* * * * *

UNITED STATES PATENT AND TRADEMARK OFFICE

CERTIFICATE OF CORRECTION

PATENT NO. : 4,358,078

DATED : November 9, 1982

INVENTOR(S) : Wilbur E. Tolliver

It is certified that error appears in the above—identified patent and that said Letters Patent is hereby corrected as shown below:

Column 4, line 30:
"foled" should be --folded--

Column 6, line 12:
"place" should be --plane--

Column 6, line 66:
"quad" should be --quadrant--

Column 6, line 67:
"strand" should be --strands--

Column 6, line 68 (first occurrence):
after "circumferential" insert --strands--

Column 6, line 68:
after "through" insert --a--

UNITED STATES PATENT AND TRADEMARK OFFICE

CERTIFICATE OF CORRECTION

PATENT NO. : 4,358,078

DATED : November 9, 1982

INVENTOR(S) : Wilbur E. Tolliver

It is certified that error appears in the above—identified patent and that said Letters Patent is hereby corrected as shown below:

Column 6, line 68:
"quad" should be --quadrant--

Column 7, line 1:
after "ential" insert --strand--

Column 7, line 2:
after "circumferential" insert --strand--

Signed and Sealed this

*Twenty-ninth* Day of *March 1983*

[SEAL]

*Attest:*

GERALD J. MOSSINGHOFF

*Attesting Officer*

*Commissioner of Patents and Trademarks*